US008840106B2

(12) United States Patent
Hasegawa

(10) Patent No.: US 8,840,106 B2
(45) Date of Patent: Sep. 23, 2014

(54) IMAGE FORMING APPARATUS, CONTROL METHOD FOR IMAGE FORMING APPARATUS, AND STORAGE MEDIUM

(71) Applicant: Canon Kabushiki Kaisha, Tokyo (JP)

(72) Inventor: Teppei Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/753,241

(22) Filed: Jan. 29, 2013

(65) Prior Publication Data

US 2013/0193641 A1 Aug. 1, 2013

(30) Foreign Application Priority Data

Feb. 1, 2012 (JP) ..... 2012-019435

(51) Int. Cl.

| | |
|---|---|
| ***B65H 31/04*** | (2006.01) |
| ***G03G 15/00*** | (2006.01) |
| ***B65H 43/02*** | (2006.01) |
| ***B65H 31/10*** | (2006.01) |
| ***B65H 29/00*** | (2006.01) |

(52) U.S. Cl.

CPC ..... *B65H 29/00* (2013.01); *B65H 2511/417* (2013.01); *B65H 2511/30* (2013.01); *G03G 15/6552* (2013.01); *B65H 2601/321* (2013.01); *B65H 2601/325* (2013.01); *B65H 2511/20* (2013.01); *B65H 43/02* (2013.01); *B65H 2402/441* (2013.01); *B65H 2801/06* (2013.01); *G03G 15/55* (2013.01); *B65H 31/10* (2013.01); *B65H 2402/45* (2013.01)

USPC ..... 271/213; 271/279; 271/292

(58) Field of Classification Search

USPC ..... 271/279, 294, 298, 213, 241

See application file for complete search history.

(56) References Cited

U.S. PATENT DOCUMENTS 8,400,653 B2 * 3/2013 Fujino ..... 358/1.15

FOREIGN PATENT DOCUMENTS

| | | | |
|---|---|---|---|
| JP | 2009-035826 A | | 2/2009 |
| JP | 2009-149436 A | | 7/2009 |
| JP | 2010189148 A | * | 9/2010 |

* cited by examiner

*Primary Examiner* — Michael McCullough
*Assistant Examiner* — Howard Sanders
(74) *Attorney, Agent, or Firm* — Canon U.S.A., Inc., IP Division

(57) ABSTRACT

An image forming apparatus which performs image forming processing on sheets and outputs the sheets to a sheet stacking unit includes an instruction unit configured to issue an instruction for shutting down the image forming apparatus, an acquisition unit configured to acquire a remaining amount of sheets stacked in the sheet stacking unit, and a control unit configured to display, when the instruction unit receives the instruction, a warning indicating a shift to a state in which sheets are not extractable from the sheet stacking unit, based on the remaining amount of sheets acquired by the acquisition unit.

12 Claims, 15 Drawing Sheets

FIG. 14

SETTING/REGISTRATION

DEVICE ABOUT WHICH WARNING IS GIVEN WHEN THERE IS REMAINING SHEET AT THE TIME OF SHUTDOWN

- SHEET FEED DEVICE ☑
- SHEET DISCHARGE DEVICE ☑
- ONLY POD DECK ☐
- ONLY STACKER ☑

CLOSE OK

FIG. 15

SETTING/REGISTRATION

TYPE OF SHUTDOWN WHICH CAUSES WARNING TO BE GIVEN WHEN THERE IS REMAINING SHEET AT THE TIME OF SHUTDOWN

- MAIN BODY POWER BUTTON ☑
- SHUTDOWN TIMER ☑
- REMOTE SHUTDOWN ☑

CLOSE OK

IMAGE FORMING APPARATUS, CONTROL METHOD FOR IMAGE FORMING APPARATUS, AND STORAGE MEDIUM

BACKGROUND OF THE INVENTION

1. Field of the Invention

Aspects of the present invention generally relate to an image forming apparatus having a sheet stacking apparatus that stacks sheets, a control method for the image forming apparatus, and a storage medium.

2. Description of the Related Art

The variation in image forming apparatuses advances, and an image forming apparatus is used to connect a large number of apparatuses, such as a sheet stacking apparatus for feeding or discharging a sheet or a finishing apparatus, to the image forming apparatus for cooperation.

A sheet stacking apparatus for discharging a printed sheet has, as an accessory, an elevating tray or a carriage to carry a large amount of sheets. The elevating tray is usually moved up to stack the printed sheets. However, the elevating tray needs to be mechanically moved down to extract the sheet from the sheet stacking apparatus.

Therefore, if a power supply of the sheet stacking apparatus is turned off while the elevating tray is moved up, the power supply needs to be turned on again so that the elevating tray is moved down to extract the sheet remaining in the sheet stacking apparatus.

A sheet stacking apparatus that feeds a sheet before printing includes an open button to open the sheet stacking apparatus. When detecting that the open button is pressed, the sheet stacking apparatus is mechanically opened. Therefore, if the power supply of the sheet stacking apparatus is turned off in a normal state, the power supply then needs to be turned on again and the open button of the sheet stacking apparatus needs to be pressed to extract the sheet remaining in the sheet stacking apparatus.

Japanese Patent Application Laid-Open No. 2009-35826 discusses a sheet stacking apparatus in which an elevating tray is moved down when a power supply of the apparatus is turned off to extract the sheet from the apparatus. In the sheet stacking apparatus discussed in Japanese Patent Application Laid-Open No. 2009-35826, the elevating tray is also moved down when the power supply is turned off, and the sheet can be thus extracted.

However, in the sheet stacking apparatus discussed in Japanese Patent Application Laid-Open No. 2009-35826, the elevating tray is always moved down without a consideration of a case where there are not any sheets in the sheet stacking apparatus when the power supply is turned off. Therefore, an unnecessary time is required so that the elevating tray is moved up when the power supply is turned on again.

The above operation is not addressed when the sheet is not extracted with a configuration of the feeding sheet stacking apparatus when the power supply is turned off.

SUMMARY OF THE INVENTION

An aspect of the present invention relates to a method for preventing a remaining sheet from being left in a sheet stacking apparatus for a long time by allowing a user to check whether there is a remaining sheet left in the sheet stacking apparatus when a power supply of a main body is turned off.

According to an aspect of the present invention, an image forming apparatus which performs image forming processing on sheets and outputs the sheets to a sheet stacking unit includes an instruction unit configured to issue an instruction for shutting down the image forming apparatus, an acquisition unit configured to acquire a remaining amount of sheets stacked in the sheet stacking unit, and a control unit configured to display, when the instruction unit receives the instruction, a warning indicating a shift to a state in which sheets are not extractable from the sheet stacking unit, based on the remaining amount of sheets acquired by the acquisition unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 14 illustrates an example of a UI screen displayed on a display unit of an operation unit according to the third exemplary embodiment.

FIG. 15 illustrates another example of the UI screen displayed on the display unit of the operation unit according to the third exemplary embodiment.

DESCRIPTION OF THE EMBODIMENTS

Various exemplary embodiments, features, and aspects of the invention will be described in detail below with reference to the drawings.

Figure 1:
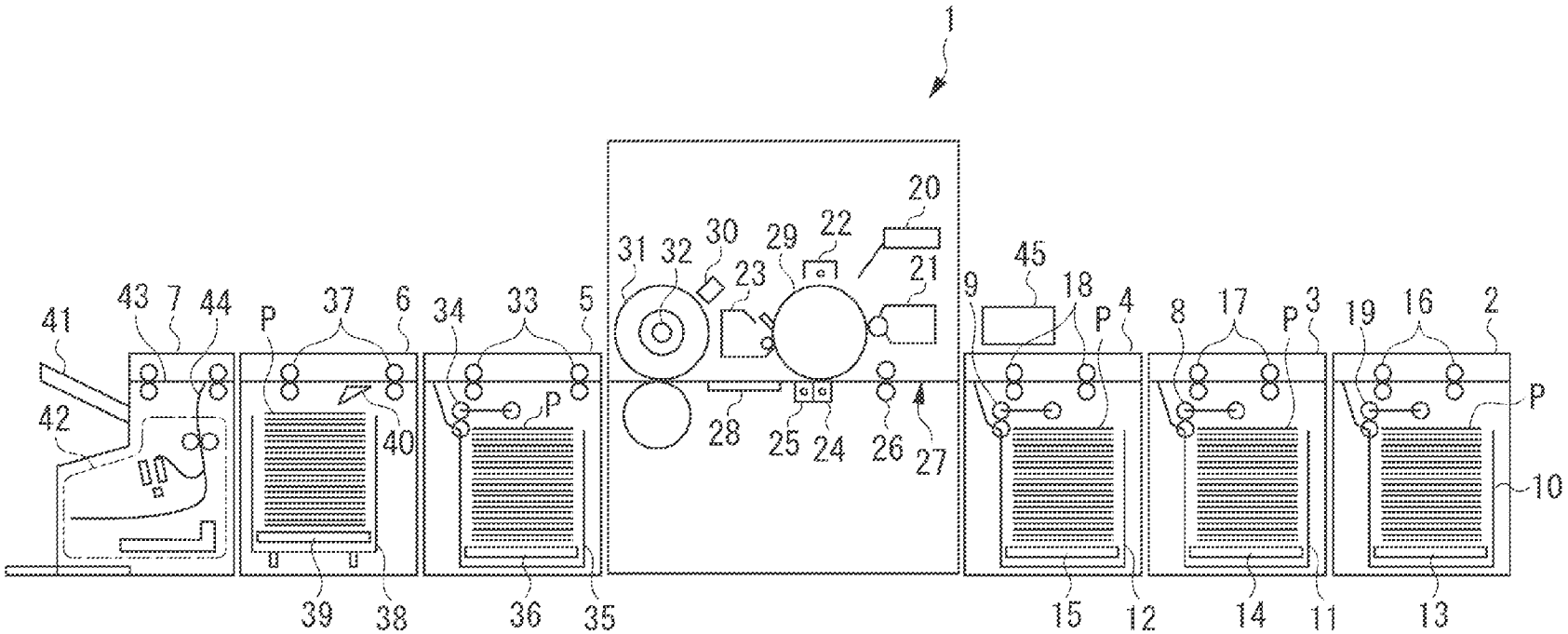
FIG. 1 illustrates a schematic cross-sectional view of a configuration of an image forming apparatus according to a first exemplary embodiment.

FIG. 1 illustrates a schematic cross-sectional view of a configuration of an image forming apparatus according to a first exemplary embodiment. According to the present exemplary embodiment, the image forming apparatus including a communication function for communication with an external device is illustrated as an example. Further, according to the present exemplary embodiment, the image forming apparatus is illustrated as an example of image forming processing with connection of a plurality of sheet stacking units that stack sheets on a sheet tray moved up. The image forming apparatus can receive a print job or an instruction for turning off a power supply from a data processing apparatus via a network.

Referring to FIG. 1, feeding sheet stacking apparatuses 2, 3, and 4 store sheets P, and feed the sheets P to an image forming apparatus main body 1. The feeding sheet stacking apparatuses 2, 3, and 4 include the same configuration. An inserter 5 performs sheet post-processing, specifically, performs post processing of an interleaf or insertion of a tab sheet to the sheet P to which an image is formed. A stacker 6 performs sheet post-processing for stacking the sheets P. A finisher 7 performs post-processing such as staple of a sheet stack containing a plurality of sheets P subjected to bookbinding processing. In the example in FIG. 1, the sheet post-processing apparatus is an inline type of the image forming apparatus main body 1. However, a conveyance path of the sheet processing apparatus is not limited to the inline-type image forming apparatus main body 1.

The image forming apparatus main body 1 includes a photosensitive drum 29. Further, the image forming apparatus main body 1 includes, around the photosensitive drum 29, a transfer charger 24 that uniformly charges the photosensitive drum 29, a separation charger 25 that separates the sheet P from the photosensitive drum 29, and a cleaner 23 that collects toner remaining on the photosensitive drum 29 without transfer.

The feeding sheet stacking apparatuses 2, 3, and 4 include sheet stacking units 10, 11, and 12 that individually contain the sheets P, and sheet feed units 9, 8, and 19 that respectively feed the sheets P contained in the sheet stacking units 10, 11, and 12. The feeding sheet stacking apparatuses 2, 3, and 4 include elevating trays 13, 14, and 15 that adjust a sheet surface height of the sheet P to a position for feeding the sheets P by the sheet feed units 9, 8, and 19, and sheet conveyance units 16, 17, and 18 that convey the sheets P.

A sheet detection sensor 27 detects the sheet P fed to the image forming apparatus main body 1 from the feeding sheet stacking apparatus 2, 3, or 4, and the sheet P contacts a registration roller 26. Skew of the sheet P is corrected and the sheet P is conveyed to the transfer charger 24 to transfer a toner image to the sheet P. Then, a conveyance belt 28 conveys the sheet P toward a fixing roller 31.

The fixing roller 31 includes a pair of rollers. A top roller of the fixing roller 31 as the pair has a halogen heater 32 built-in. A thermistor 30 is disposed near the top roller of the fixing roller 31 to detect a temperature of the fixing roller 31. The halogen heater 32 keeps a high temperature of the fixing roller 31. The sheet P passing through the fixing roller 31 is conveyed to the inserter 5.

The inserter 5 includes a sheet stacking unit 35 that stores the sheet P, a sheet conveyance unit 34 that feeds the sheet P stored in the sheet stacking units 35 and then conveys the sheet P, and an elevating tray 36 that moves up the sheet P to the sheet surface height so that the sheet conveyance unit 34 feeds the sheet P.

The stacker 6 includes a sheet stacking unit 38 that stores the sheet P, a sheet conveyance unit 37 that conveys the sheet P stored in the sheet stacking units 38, and an elevating tray 39. Further, a diverter 40 switches a conveyance path of the stacker 6. The stacker 6 in FIG. 1 stacks the sheet P to the sheet stacking unit 38, or conveys the sheet P to a downstream device.

The finisher 7 includes a discharge tray 41 that stacks the sheet P, and stacks the sheet P discharged via a conveyance path 43 to the discharge tray 41. A saddle unit 42, which is surrounded by a dotted line in the finisher 7 as illustrated in FIG. 1, performs saddle processing of the sheet P conveyed via a conveyance path 44.

An operation unit 45 includes a display device that displays a printing status of the image forming apparatus, and an input device that inputs a print setting. Further, the operation unit 45 displays a button for receiving a shutdown instruction (instruction for turning off the power) of the image forming apparatus main body 1 on a user interface (UI) screen. The image forming apparatus main body 1 includes a power switch for receiving an instruction for directly shutting down the power or an instruction for supplying the power, from a user. The power switch is also referred to as a seesaw switch. According to the present exemplary embodiment, the image forming apparatus main body 1 can receive the instruction for remotely shutting down the power from a data processing apparatus to turn off the power, as a unit except for the power switch. Further, the image forming apparatus main body 1 can receive the instruction for shutting down the power, notified at a power-off time set by the user with a power-off timer operated in the image forming apparatus main body 1.

Figure 2:
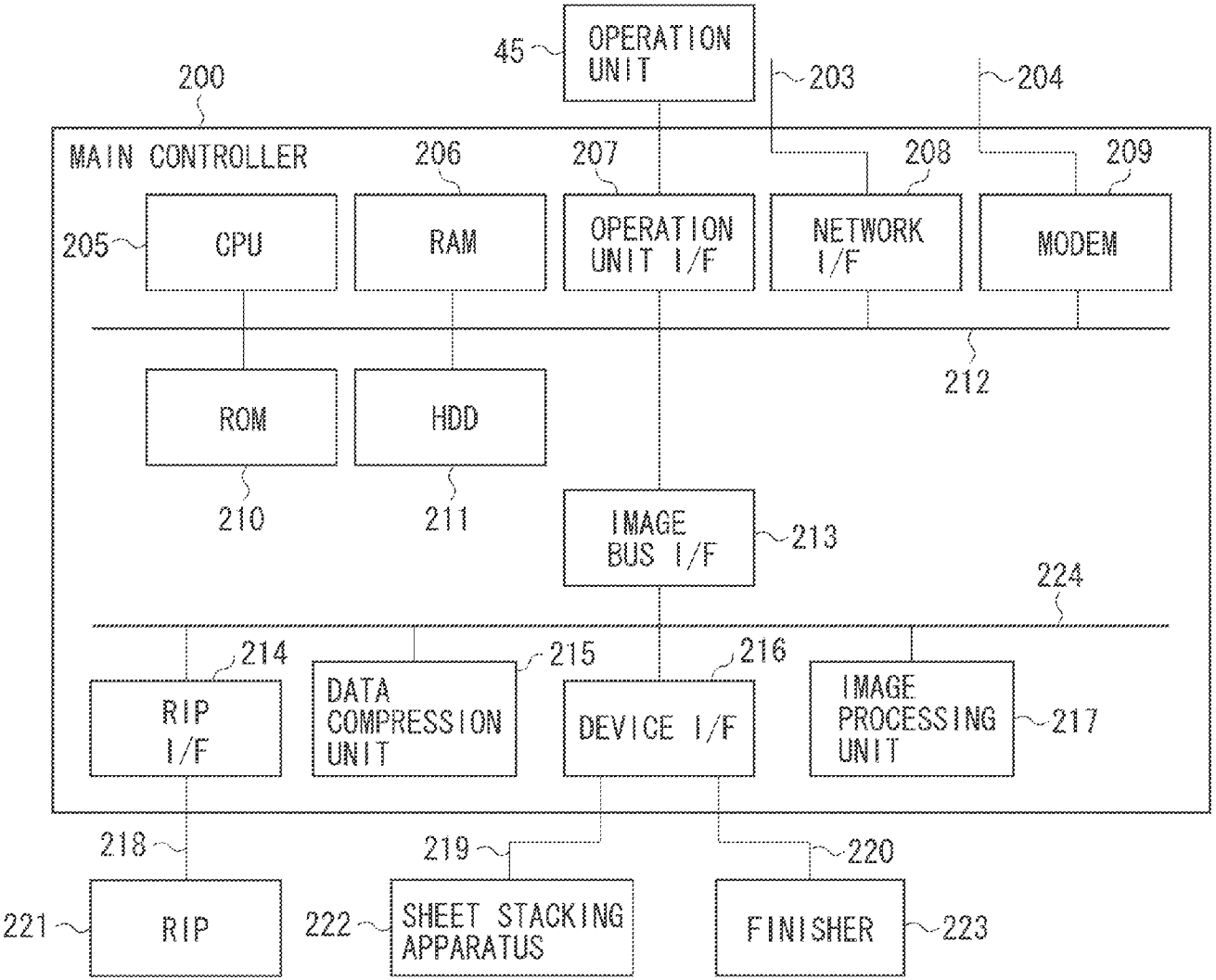
FIG. 2 illustrates a block diagram of a configuration of a main controller according to the first exemplary embodiment.

FIG. 2 illustrates a block diagram of a configuration of a main controller 200 provided for the image forming apparatus main body 1 in FIG. 1.

Referring to FIG. 2, the main controller 200 of the image forming apparatus main body 1 includes a central processing unit (CPU) 205, a random access memory (RAM) 206, an operation unit interface (I/F) 207, a network interface (I/F) 208, a modem 209, a read only memory (ROM) 210, and a hard disk drive (HDD) 211.

The main controller 200 of the image forming apparatus main body 1 includes, via an image bus interface (I/F) 213, a raster image processor (RIP) interface (I/F) 214, a data compression unit 215, a device interface (I/F) 216, and an image processing unit 217. The main controller 200 further includes a CPU bus 212 and an image bus 224.

A network cable 203, which is connectable to an external device via a network, is connected to the network interface (I/F) 208. A line cable 204 for connection with the external device via a telephone line is connected to the modem 209.

The CPU 205 executes a program for controlling the entire main controller 200. The RAM 206 is managed by a program operating on the CPU 205. The RAM 206 is also used as a reception buffer that temporarily stores image data received from the external device or an image data buffer that temporarily stores image data rasterized by a raster image processor (RIP) 221. The ROM 210 stores the program operating on the CPU 205, or data. The HDD 211 is a nonvolatile device that can store various data for a long term.

The operation unit I/F 207 connects the operation unit 45 to the main controller 200. The image bus interface (I/F) 213 connects the CPU bus 212 to the image bus 224.

The RIP 221 is connected to the RIP I/F 214 via a data bus 218. The RIP 221 is a rasterizing board having a function for converting page-description language data (PDL data) input from the external device into bitmap image data. The RIP I/F 214 connects the RIP 221 to the image bus 224 via the data bus 218. The data compression unit 215 compresses the rasterized image data.

A sheet stacking apparatus 222 is connected to the device I/F 216 via a data bus 219, and a finisher 223 is connected to the device I/F 216 via a data bus 220. The sheet stacking apparatus 222 performs sheet post-processing corresponding to the stacker 6 in FIG. 1. The finisher 223 performs sheet post-processing corresponding to the finisher 7 in FIG. 1.

The CPU 205 issues a control command to the finisher 223 and the sheet stacking apparatus 222 in response to a signal instructed via the network cable 203 from the operation unit 45 or the external device via the data buses 219 and 220. The image processing unit 217 performs various types of image processing of the bit map image data generated by the RIP 221. The image processing unit 217 further has a function for digital processing of the bit map image data.

Figure 3:
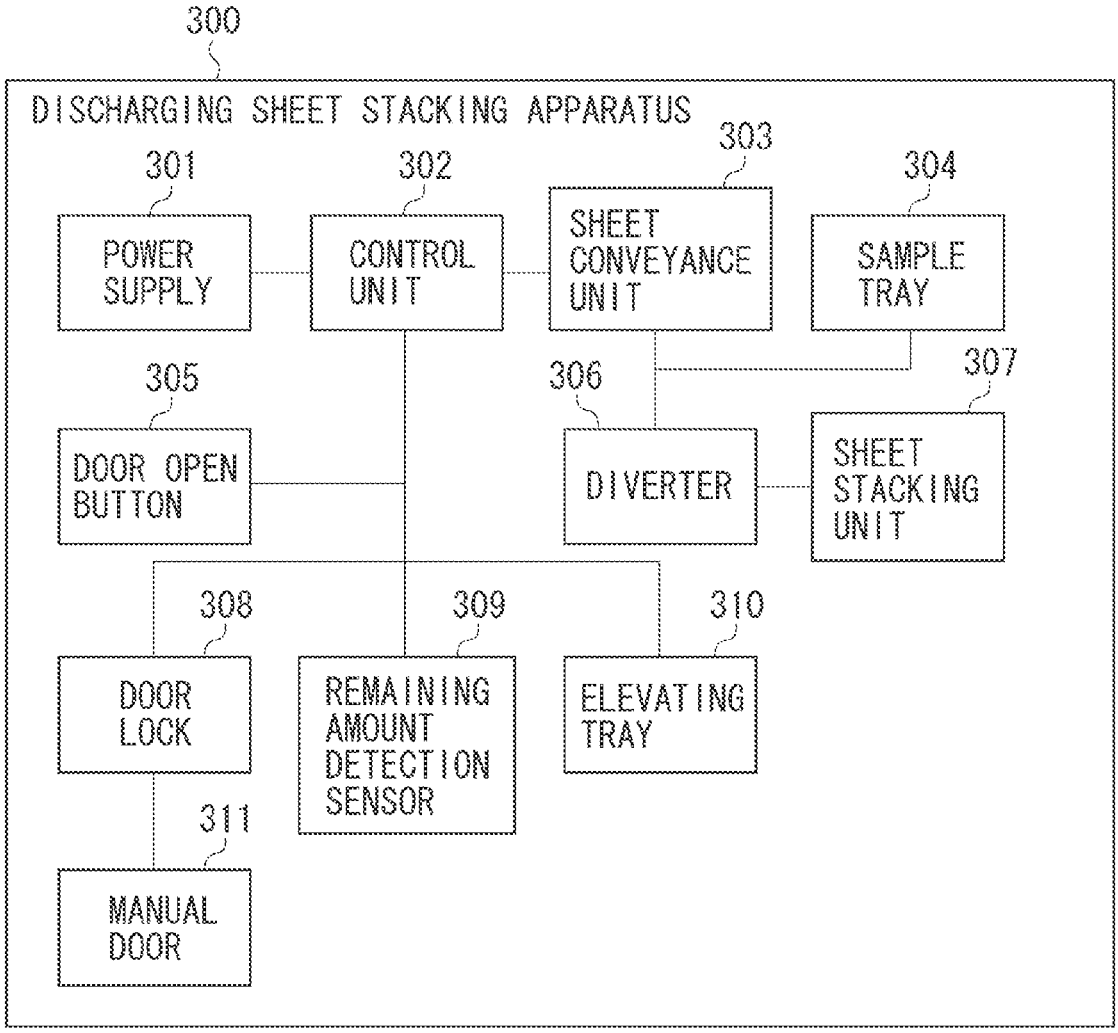
FIG. 3 illustrates a block diagram of a hardware configuration of a discharging sheet stacking apparatus according to the first exemplary embodiment.

FIG. 3 illustrates a block diagram of a hardware configuration of a discharging sheet stacking apparatus 300 according to the present exemplary embodiment. The discharging sheet stacking apparatus 300 is an example of the sheet stacking apparatus 222 in FIG. 2, and is connected to the image forming apparatus main body 1 via the data bus 219 and the device I/F 216. A plurality of discharging sheet stacking apparatuses 300 can be connected to the image forming apparatus main body 1.

Referring to FIG. 3, a control unit 302 controls units such as an elevating tray 310 in the discharging sheet stacking apparatus 300 in response to a command from the CPU 205 in the main controller 200.

The CPU 205 in FIG. 2 stacks the sheet P to which data is printed by the image forming apparatus main body 1 and which is conveyed via the sheet conveyance unit 303 in FIG. 3 to a sheet stacking unit 307. The CPU 205 can change a sheet conveyance destination to a sample tray 304 by adjusting a diverter 306.

A remaining amount detection sensor 309 detects the number of remaining sheets P stacked in the sheet stacking unit 307, and notifies the CPU 205 of the number of remaining sheets P.

The elevating tray 310 is positioned at a height corresponding to the number of remaining sheets P in the sheet stacking unit 307 to stack the sheet P conveyed via the sheet conveyance unit 303 and the diverter 306. In general, door lock 308 is set to prevent the extraction of the sheet P by opening a manual door 311.

The CPU 205 detects that a door open button 305 is pressed. Then, the elevating tray 310 is moved down, and the door lock 308 is released. At this time, the manual door 311 can be opened to extract the sheet P stored in the sheet stacking unit 307.

The discharging sheet stacking apparatus 300 is connected to a power supply 301. When the power supply 301 does not supply the power, the CPU 205 cannot operate the elevating tray 310 and cannot set and release a door lock mechanism of the manual door 311. That is, after turning off the power supply 301, the manual door 311 cannot be manually opened/closed. Therefore, if the power is shut down while the sheet P is stacked to the elevating tray 310, the sheet P stacked on the elevating tray 310 cannot be extracted, unless an instruction for turning on the power supply 301 again is issued.

However, the CPU 205 moves down the elevating tray 310 and releases the door lock 308 while the power supply 301 is turned on, then shutting down the power supply 301. At this time, even when the power supply 301 is shut down, the manual door 311 can be opened to extract the sheet P stored in the sheet stacking unit 307.

Figure 4A:
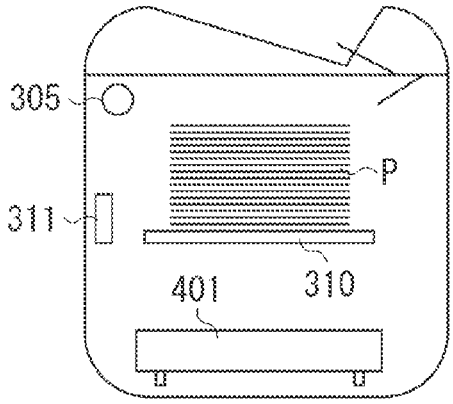
FIGS. 4A, 4B, and 4C illustrate sheet stacking states of the discharging sheet stacking apparatus in FIG. 3 according to the first exemplary embodiment.
Figure 4B:
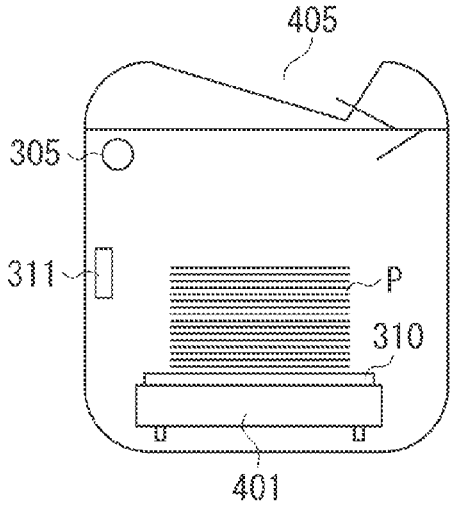
Figure 4C:
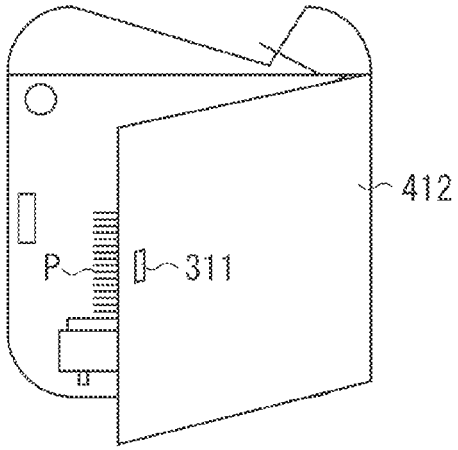
Figure 5:
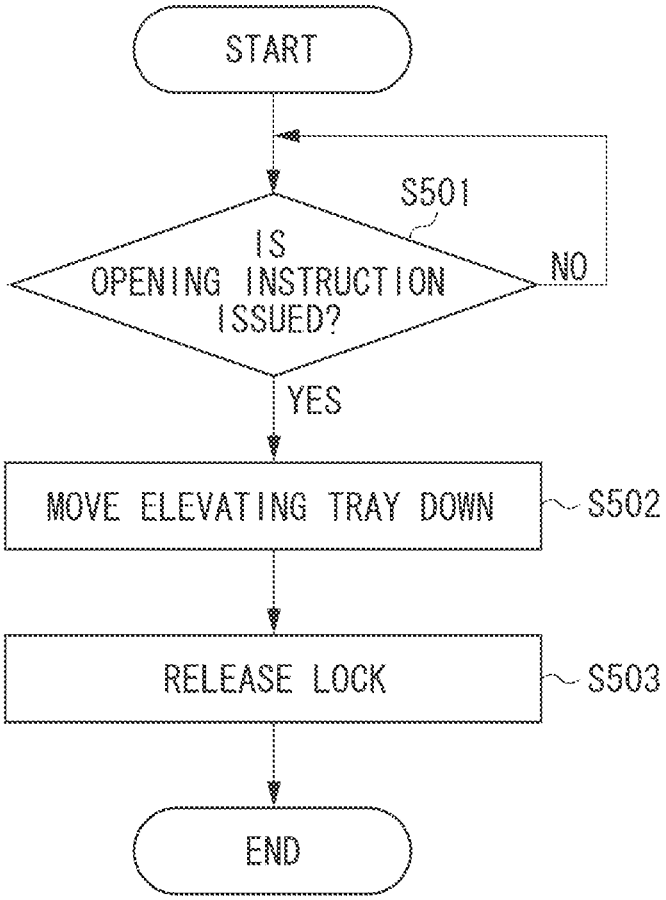
FIG. 5 illustrates a flowchart of a control method for a sheet post-processing apparatus according to the first exemplary embodiment.

FIGS. 4A, 4B, and 4C illustrate sheet stacking states of the discharging sheet stacking apparatus 300 illustrated in FIG. 3. FIG. 5 illustrates a flowchart of a control method for the sheet post-processing apparatus according to the present exemplary embodiment. In this example, the sheet P that is stacked and stored in the discharging sheet stacking apparatus 222 is extracted. Steps are realized by loading a control program stored in the ROM 210 or the HDD 211 to the RAM 206 and executing the control program by the CPU 205. A processing flow executed by the CPU 205 to extract the sheet P stored in the discharging sheet stacking apparatus 300 is described with reference to FIGS. 4A, 4B, and 4C.

In step S501, the CPU 205 detects in the sheet stacking state in FIG. 4A that the user presses the door open button 305. In step S502, the CPU 205 controls an elevating tray mechanism so that the elevating tray 310 on which the sheets P are stacked is moved down to the position of a carriage 401. As a consequence, the elevating tray 310 is moved down to the position illustrated in FIG. 4B, and stops at that position.

In step S503, the CPU 205 releases the door lock 308. Then, the present processing ends. Referring to FIG. 4C, the user can open the manual door 311 from the front side of the image forming apparatus main body 1, and can extract the stacked and stored sheets P.

Figure 6:
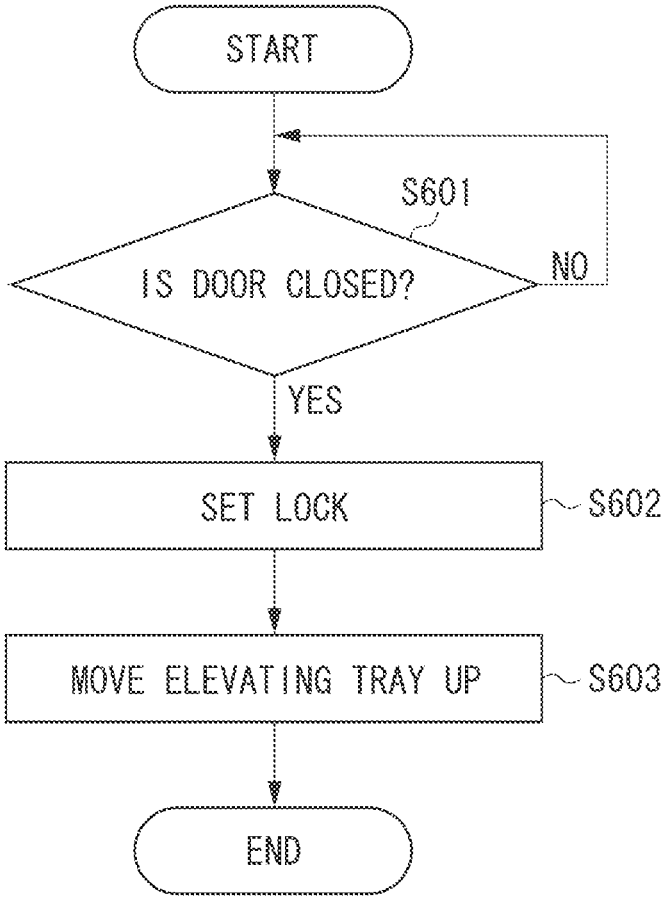
FIG. 6 illustrates another flowchart of the control method for the sheet post-processing apparatus according to the first exemplary embodiment.

FIG. 6 illustrates another flowchart of the control method for the sheet post-processing apparatus according to the present exemplary embodiment. In this example, the sheet P stored in the discharging sheet stacking apparatus 300 is extracted, the door is then closed, and the situation is back to the initial one. Steps are realized by loading a control program stored in the ROM 210 or the HDD 211 to the RAM 206 and executing the control program by the CPU 205.

In step S601, the CPU 205 detects that the user closes the door. In step S602, the CPU 205 sets the door lock 308 to a locking state. In step S603, the CPU 205 controls the elevating tray mechanism to move up the elevating tray 310. Then, the present processing ends.

As a consequence, the elevating tray 310 of the discharging sheet stacking apparatus 222 returns to the initial stacking stop position.

According to the present exemplary embodiment, referring to FIG. 5, the sheet tray is moved down in response to an instruction for opening the door, which is used to extract the stacked sheet P from the sheet tray, and the lock mechanism is released. When receiving an instruction for closing the door, which is used to extract the stacked sheet P from the sheet tray, the CPU 205 sets the lock mechanism in response to the closing instruction, as illustrated in FIG. 6, and controls the door/tray to move up the sheet tray. When the power supply is shut down, the CPU 205 sets the lock mechanism, and controls an operation for preventing the instruction for opening the door from being received from the user.

Figure 7:
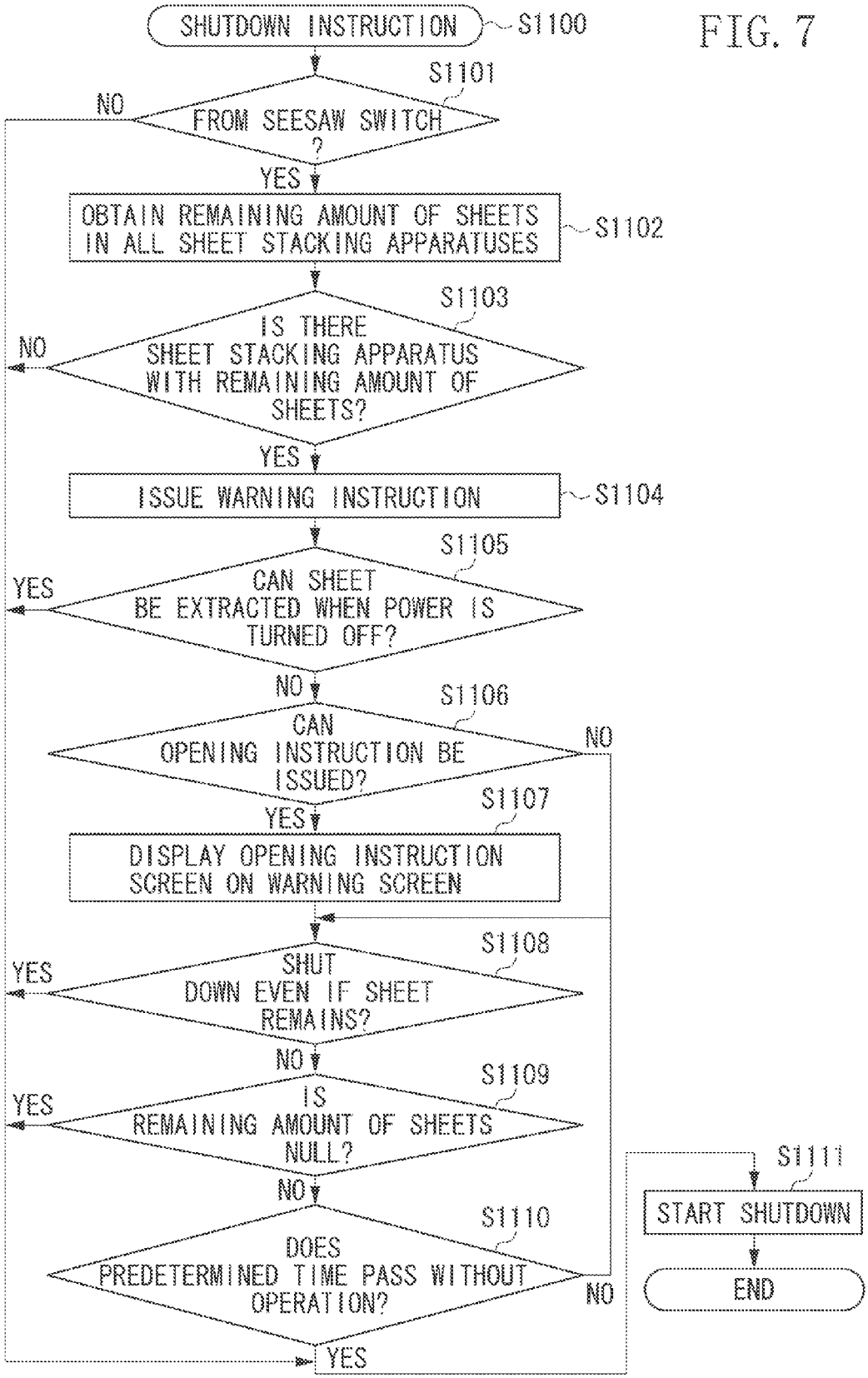
FIG. 7 illustrates another flowchart of the control method for the sheet post-processing apparatus according to the first exemplary embodiment.

FIG. 7 illustrates another flowchart of the control method for the sheet post-processing apparatus according to the present exemplary embodiment. In this example, the discharging sheet stacking apparatus 222 is shut down. Steps are realized by loading a control program stored in the ROM 210 or the HDD 211 to the RAM 206 and executing the control program by the CPU 205. The discharging sheet stacking apparatus 222 includes a plurality of stacking units, e.g., a top tray, a right stacker, and a left stacker, each of which includes a sensor for detecting whether there is a stacked sheet P. A driving arm that keeps the stacker or tray is fixed to the elevating unit, as discussed in Japanese Patent Application Laid-Open No. 2009-149436. Then, the driving arm can be moved up/down. An elevating motor and a roller mechanism that drives a belt are arranged at predetermined positions in the elevating unit. The motor is rotated in the clockwise/counterclockwise direction in response to an instruction of the CPU 205, thereby moving up/down the driving arm.

Control is described to display, on a display unit, a warning indicating that the state shifts to such a state in which the sheet P cannot be extracted from any of the sheet stacking apparatuses. Specifically, when the CPU 205 receives a shutdown instruction with the power switch from the user, the warning is displayed to indicate shifting to a state in which the sheet P cannot be extracted, based on the remaining amount of the sheets P from each of the connected sheet stacking apparatuses.

In step S1100, the CPU 205 receives a shutdown instruction. In step S1101, the CPU 205 determines whether the shutdown instruction is issued with the physical power switch (seesaw switch) operated in the image forming apparatus main body 1 by the user. If the CPU 205 determines that the shutdown instruction is not issued with the seesaw switch (NO in step S1101), then in step S1111, the CPU 205 performs predetermined shutdown processing. The present processing ends.

In step S1102, the CPU 205 acquires the remaining amount of the sheets P in all of the discharging sheet stacking apparatuses (stackers) with the remaining amount detection sensor 309 disposed in each tray. In step S1103, the CPU 205 determines whether the remaining amount of the sheets P is null in all of the discharging sheet stacking apparatuses (stackers). If the CPU 205 determines that the remaining amount of the sheets P is null in all of the discharging sheet stacking apparatuses (stackers) (NO in step S1103), then in step S1111, the CPU 205 performs predetermined shutdown processing. Then, the present processing ends.

Figure 8:
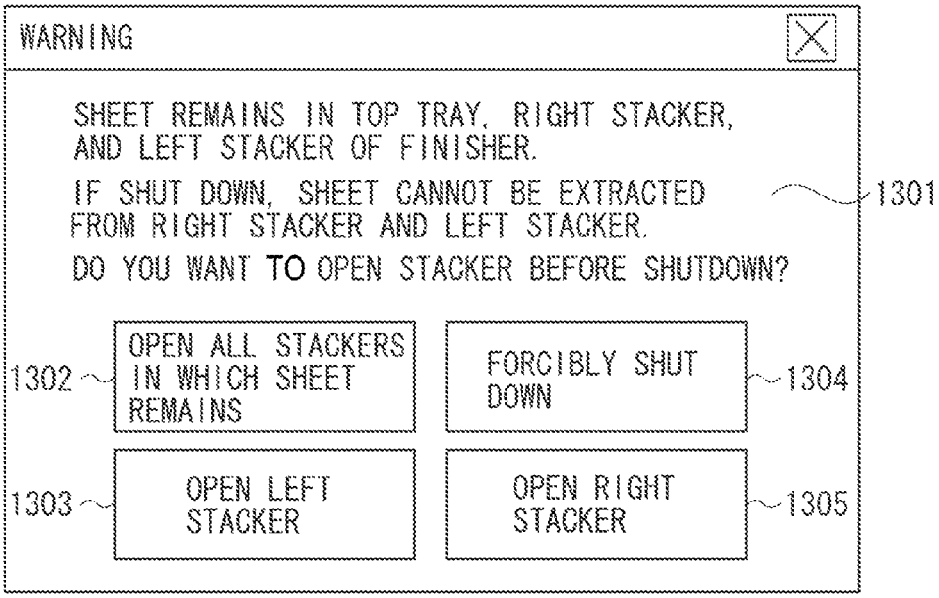
FIG. 8 illustrates an example of a user interface (UI) screen displayed on a display unit of an operation unit according to the first exemplary embodiment.

If the CPU 205 determines that the remaining amount of the sheets P is not null in all of the discharging sheet stacking apparatuses (stackers) (YES in step S1103), then in step S1104, the CPU 205 causes the display unit of the operation unit 45 connected to the image forming apparatus main body 1 to display a warning screen prompting the user to extract the sheet P. FIG. 8 illustrates an example of the warning displayed at that time.

The warning screen illustrated in FIG. 8 displays a message 1301, which indicates the presence or absence of the remaining amount of the sheets P, and a forcible shutdown button 1304, which is operable to issue the shutdown instruction even when the remaining amount of the sheets P is not null. The warning message may be displayed on the operation unit 45 or a screen of the display device provided in an external device on the network connected via the network I/F.

The UI screen illustrated in FIG. 8 corresponds to a screen for displaying, on the display unit, a warning of shifting to a state in which the sheet or sheets P are not extractable from any of the sheet stacking units. The CPU 205 controls a display operation, on the UI screen, of the forcible shutdown button 1304 for receiving the shutdown instruction and buttons 1303 and 1305 for individually receiving an open instruction for doors of the sheet stacking units. Further, the CPU 205 controls a display operation, on the UI screen, of a button 1302 for receiving an open instruction for all doors of the sheet stacking units.

In step S1105, the CPU 205 determines whether there is a discharging sheet stacking apparatus 222 from which the sheet P cannot be extracted when the power supply 301 is shut down, out of the discharging sheet stacking apparatuses 222 in which the remaining amount of the sheets P is not null. If the CPU 205 determines that there is not a discharging sheet stacking apparatus 222 from which the sheet P cannot be extracted when the power supply 301 is shut down (YES in step S1105), then in step S1111, the CPU 205 executes predetermined shutdown processing. The present processing ends.

If the CPU 205 determines that there is a discharging sheet stacking apparatus 222 from which the sheet P cannot be extracted when the power supply 301 is shut down (NO in step S1105), then in step S1106, the CPU 205 determines whether an open instruction for the door of the discharging sheet stacking apparatus 222 can be issued. If the CPU 205 determines that an open instruction for the door of the discharging sheet stacking apparatus 222 can be issued (YES in step S1106), then in step S1107, the CPU 205 displays open instruction buttons 1302, 1303, and 1305 on the warning screen illustrated in FIG. 8.

If the CPU 205 determines that an open instruction for the door of the discharging sheet stacking apparatus 222 cannot be issued (NO in step S1106), the processing proceeds to step S1108.

In step S1108, the CPU 205 determines whether an instruction of the forcible shutdown button 1304 is received from the user via the warning screen in FIG. 8. If the CPU 205 determines that the instruction of the forcible shutdown button 1304 is received from the user via the warning screen in FIG. 8 (YES in step S1108), then in step S1111, the CPU 205 performs predetermined shutdown processing. The present processing ends.

If the CPU 205 determines that the instruction of the forcible shutdown button 1304 is not received from the user via the warning screen in FIG. 8 (NO in step S1108), the processing proceeds to step S1109. In step S1109, the CPU 205 determines whether the remaining amount of the sheets P is null in all of the discharging sheet stacking apparatuses 222 with the remaining amount detection sensor 309. If the CPU 205 determines that the remaining amount of the sheets P is null in all of the discharging sheet stacking apparatuses 222 with the remaining amount detection sensor 309 (YES in step S1109), the processing proceeds to step S1111. In step S1111, the CPU 205 performs predetermined shutdown processing. The present processing ends.

If the CPU 205 determines that the remaining amount of the sheets P is not null in all of the discharging sheet stacking apparatuses with the remaining amount detection sensor 309 (NO in step S1109), the processing proceeds to step S1110. In step S1110, the CPU 205 determines whether a predetermined time has passed without an operation on the warning screen or an operation or instruction, such as for opening or closing the discharging sheet stacking apparatus 222, detectable by the CPU 205, after the CPU 205 displays the warning screen in FIG. 8 on the display unit of the operation unit 45. If the CPU 205 determines that the predetermined time has passed without the operation on the warning screen or the operation or instruction, such as for opening or closing the discharging sheet stacking apparatus 222, detectable by the CPU 205 (YES in step S1110), the processing proceeds to step S1111. In step S1111, the CPU 205 executes predetermined shutdown processing. The present processing ends.

If the CPU 205 determines that the predetermined time has not passed without the operation on the warning screen or the operation or instruction, such as for opening or closing the discharging sheet stacking apparatus 222, detectable by the CPU 205 (NO in step S1110), the processing returns to step S1108.

The CPU 205 executes the shutdown processing in step S1111. Then, the shutdown processing is performed on the discharging sheet stacking apparatus 222. The power supply 301 stops supplying power, and the discharging sheet stacking apparatus 222 is shut down.

With the above-described sequence, when the power supply 301 of the image forming apparatus is shut down, it is checked whether the remaining amount of the sheets P in the discharging sheet stacking apparatus 222 is null. Therefore, it is possible to prevent the sheet P from being left in the discharging sheet stacking apparatus 222 for a long time.

In step S1104, the user is notified of the discharging sheet stacking apparatus 222 in which the remaining amount of the sheets P is not null. Accordingly, it is possible to prevent the troublesomeness that the user moves to the image forming apparatus main body 1 to check the remaining amount of the sheets P in all of the discharging sheet stacking apparatuses 222.

In step S1108, it is possible to prevent a complicated operation of removal of all sheets P by the user who wants to shut down the power supply 301 even if the sheet P remains in any of the discharging sheet stacking apparatuses 222.

In step S1109, if it is detected that the remaining amount of sheets P is null in any of the discharging sheet stacking apparatuses 222, the shutdown operation automatically starts. Thus, the operation for issuing the shutdown instruction again from the user can be omitted.

The first exemplary embodiment is applied to a discharging sheet stacking apparatus. Alternatively, it can be applied to a feeding sheet stacking apparatus. In the feeding sheet stacking apparatus, the sheet can be extracted at the shutdown time to keep the quality thereof if the sheet P is left for a long time.

Figure 9:
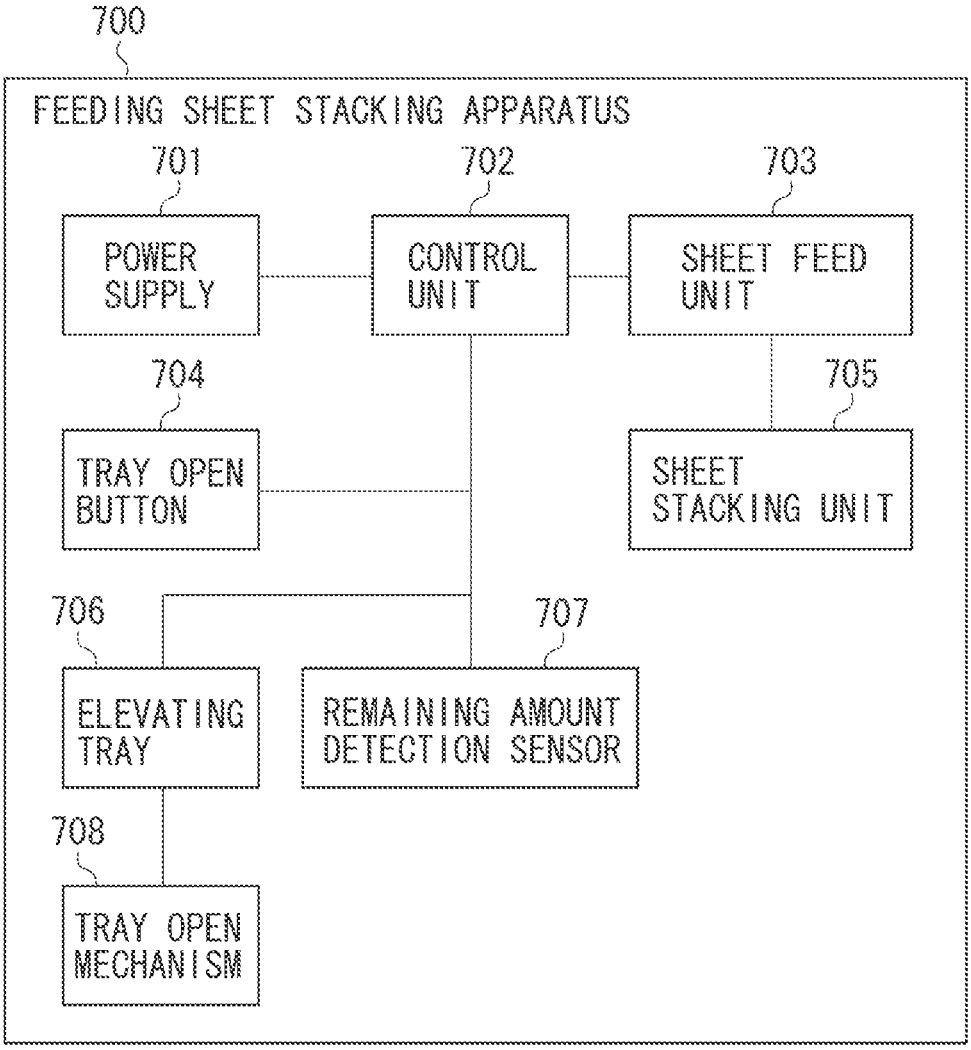
FIG. 9 illustrates a block diagram of a hardware configuration of a feeding sheet stacking apparatus according to a second exemplary embodiment.

FIG. 9 illustrates a block diagram of a configuration of the sheet processing apparatus according to the second exemplary embodiment. An example in FIG. 9 illustrates a hardware configuration of a feeding sheet stacking apparatus 700.

Referring to FIG. 9, the feeding sheet stacking apparatus 700 is an example of the sheet stacking apparatus 222 in FIG. 2, and is connected to the image forming apparatus main body 1 via the data bus 219 and the device I/F 216. A plurality of feeding sheet stacking apparatuses 700 can be connected to the image forming apparatus main body 1.

In the feeding sheet stacking apparatus 700 in FIG. 9, a control unit 702 controls various units, such as an elevating tray 706, in response to a command from the CPU 205 of the main controller 200. The CPU 205 conveys the sheet P stored in a sheet stacking unit 705 to the image forming apparatus main body 1 via a sheet feed unit 703. A remaining amount detection sensor 707 detects the remaining number of sheets P stored in a sheet stacking unit 705 in response to a command from the CPU 205, and sends a notification indicating the remaining number of sheets P. A plurality of sheet stacking units 705 are arranged depending on the configuration of the image forming apparatus, and can be managed according to the sheet size or the sheet type.

In general, the elevating tray 706 is positioned at the height corresponding to the remaining number of sheets P in the sheet stacking unit 705 to convey the sheet P via the sheet feed unit 703. With the elevating tray 706 of the sheet feed tray, a driving arm that holds the sheet feed tray includes a mechanism similar to that discussed in Japanese Patent Application Laid-Open No. 2009-149436, thereby moving up/down the driving arm.

The CPU 205 detects that the user presses a tray open button 704. Then, the CPU 205 moves down the elevating tray 706 and operates a tray opening mechanism 1701 illustrated in FIG. 10C, thereby allowing the user to extract the sheet P from the sheet stacking unit 705.

The CPU 205 is connected to a power supply 701. When the power supply 701 does not supply power, the CPU 205 cannot operate the elevating tray 706 or a tray opening mechanism 708. However, the CPU 205 moves down the elevating tray 706 while the power supply 701 is turned on. While the tray opening mechanism 708 opens the sheet stacking unit 705, the CPU 205 can shut down the power supply 701. At this time, even when the power supply 701 is shut down, the sheet P stored in the sheet stacking unit 705 can be extracted.

Figure 10A:
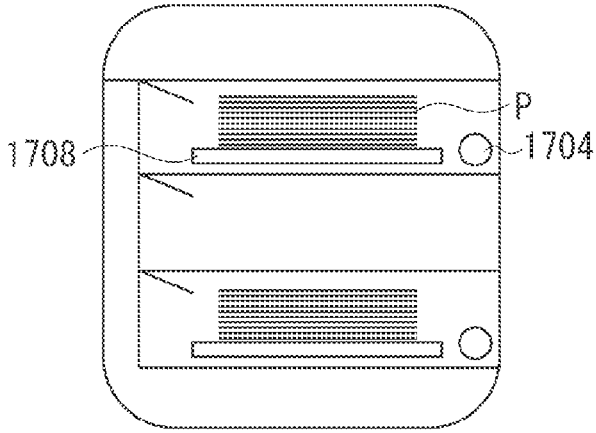
FIGS. 10A, 10B, and 10C illustrate states of the feeding sheet stacking apparatus in FIG. 9 according to the second exemplary embodiment.
Figure 10B:
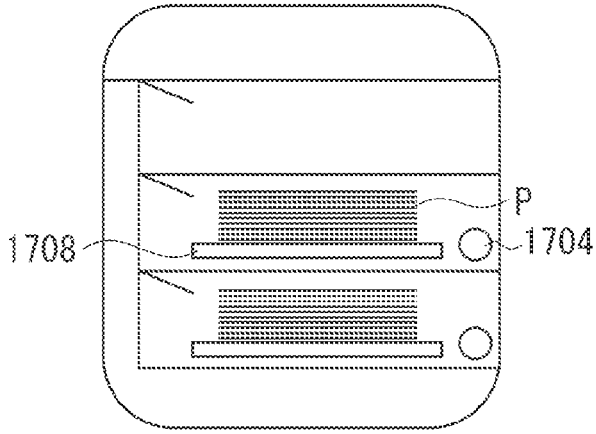
Figure 10C:
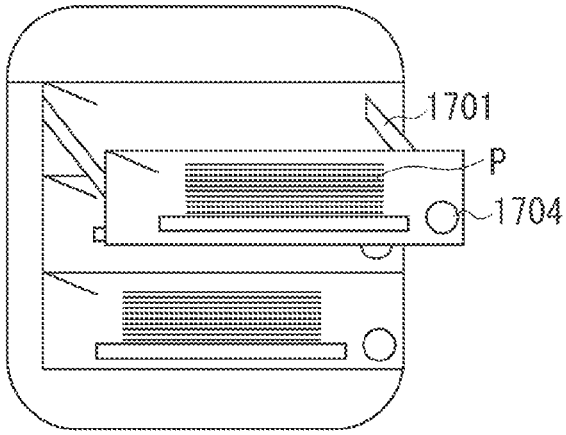

FIGS. 10A, 10B, and 10C illustrate states of the feeding sheet stacking apparatus 700 illustrated in FIG. 9.

Figure 11:
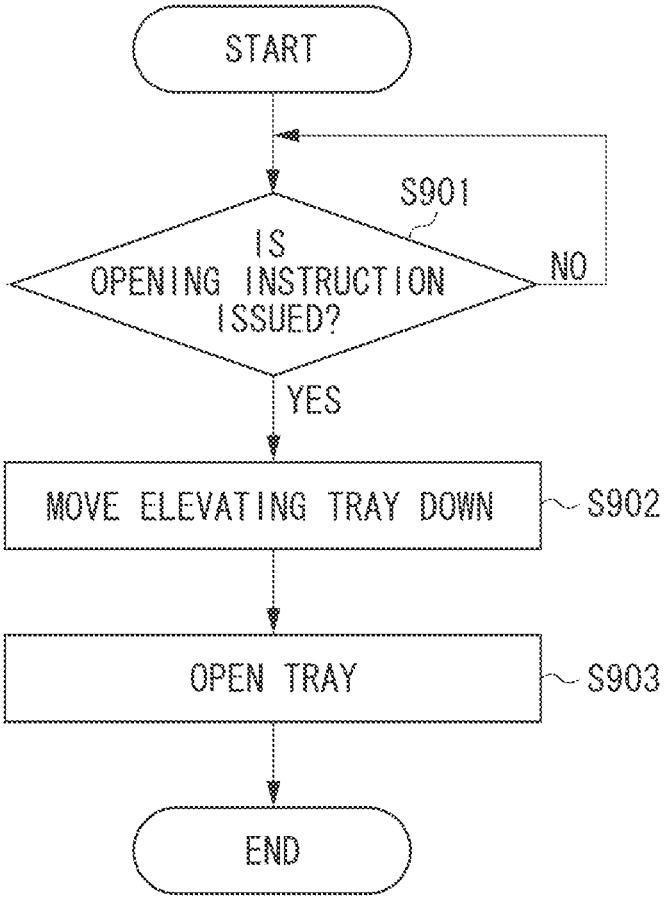
FIG. 11 illustrates a flowchart of a control method for a sheet processing apparatus according to the second exemplary embodiment.

FIG. 11 illustrates a flowchart of a control method for a sheet processing apparatus according to the present exemplary embodiment. In this example, the sheet P stacked and stored in the feeding sheet stacking apparatus 700 is extracted. Steps are realized by loading a control program stored in the ROM 210 or the HDD 211 to the RAM 206 and executing the control program by the CPU 205.

A processing flow executed by the CPU 205 when the sheet P stored in the feeding sheet stacking apparatus 700 is extracted is described with reference to FIGS. 10A, 10B, and 10C.

In step S901, the CPU 205 detects in a state illustrated in FIG. 10A that the user presses a tray open button 1704, and the processing proceeds to step S902. In step S902, the CPU 205 moves down an elevating tray 1708 (corresponding to the elevating tray 706 in FIG. 9) on which the sheet P is stacked, and comes into a state illustrated in FIG. 10B. In step S903, the CPU 205 operates the tray opening mechanism 1701 (corresponding to the tray opening mechanism 708 in FIG. 9). The present processing ends. Thus, in a state illustrated in FIG. 10C, the user can extract the sheet P.

Figure 12:
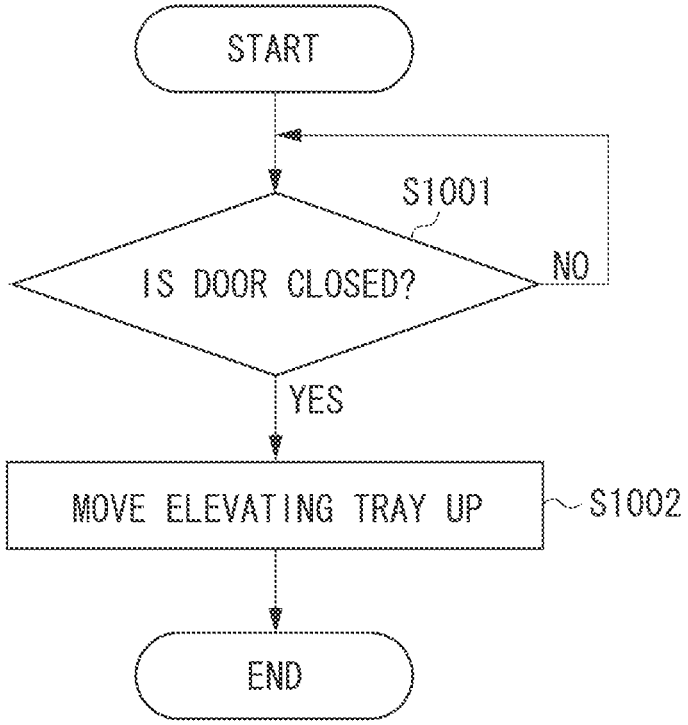
FIG. 12 illustrates another flowchart of the control method for the sheet processing apparatus according to the second exemplary embodiment.

FIG. 12 illustrates another flowchart of the control method for the sheet processing apparatus according to the present exemplary embodiment. In this example, the sheet P stored in the feeding sheet stacking apparatus 700 is extracted, the tray is closed, and the state thereafter returns to an initial one. Steps are realized by loading a control program stored in the ROM 210 or the HDD 211 to the RAM 206 and executing the control program by the CPU 205.

In step S1001, the CPU 205 detects that the tray is closed by an operation of the user. In step S1002, the CPU 205 moves up the elevating tray 1708. The present processing ends.

Thus, the feeding sheet stacking apparatus 700 returns to the initial state.

According to the present exemplary embodiment, the CPU 205, which is built in the feeding sheet stacking apparatus 700, realizes shutdown processing of the feeding sheet stacking apparatus 700. The flow is the same as the processing flow according to the first exemplary embodiment with replacement of the discharging sheet stacking apparatus 300 with the feeding sheet stacking apparatus 700.

With the feeding sheet stacking apparatus 700, when the power supply of the image forming apparatus is shut down, it is checked that the remaining amount of the sheets P in the sheet stacking apparatus is null, and it is possible to prevent the sheet P from being left in the feeding sheet stacking apparatus 700 for a long time.

According to the first and second exemplary embodiments, in step S1107 in the flowchart of FIG. 7, an open instruction screen is displayed on the warning screen. Then, the CPU 205 waits for an open instruction from the user. Alternatively, the CPU 205 may control the elevating tray of the sheet stacking apparatus having the remaining amount of the sheets P to be moved down without waiting for the open instruction.

Figure 13:
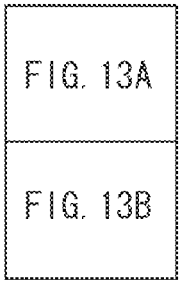
FIG. 13, which is composed of FIGS. 13A and 13B, illustrates another flowchart of a control method for a sheet post-processing apparatus according to a third exemplary.
Figure 13A:
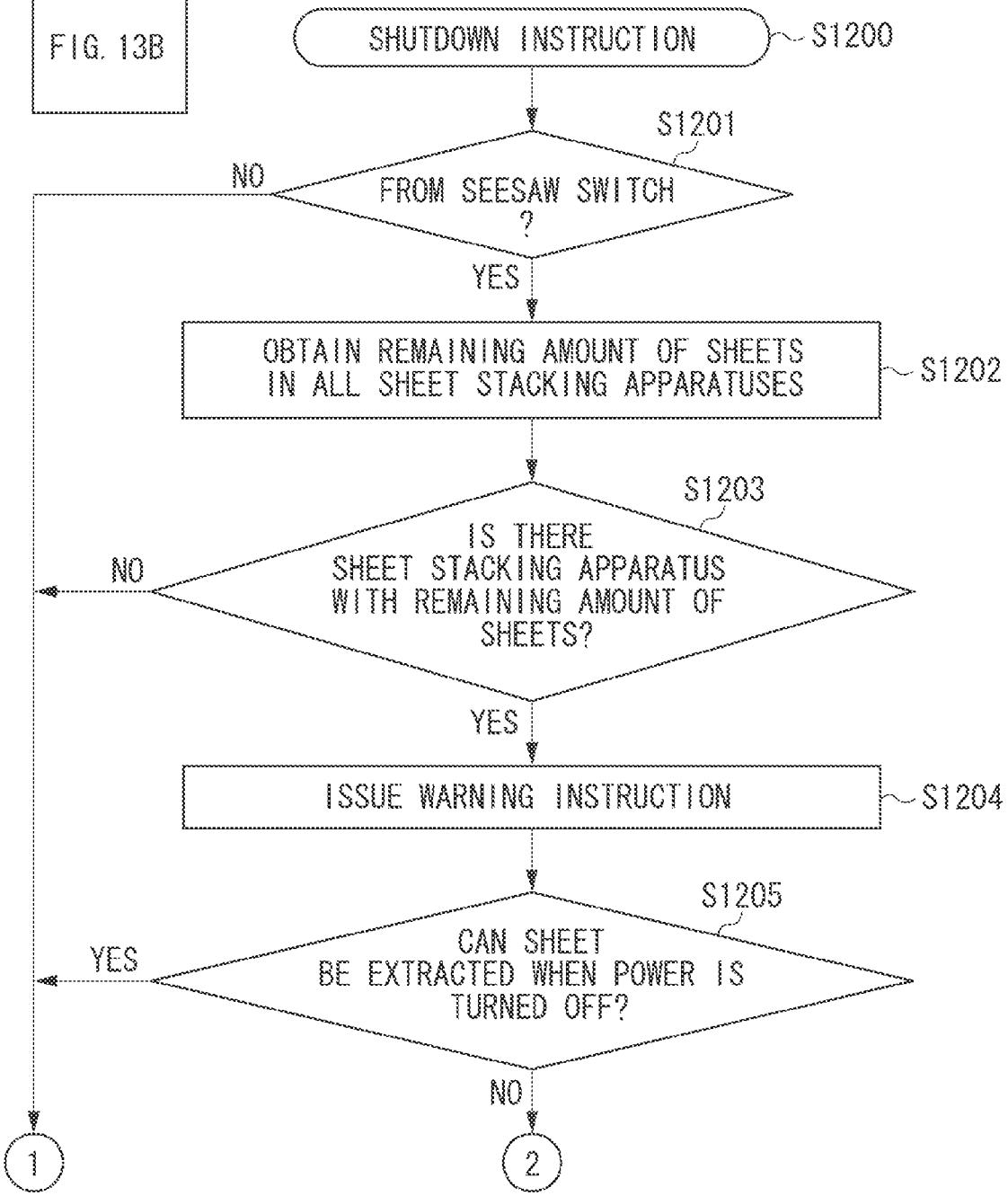
Figure 13B:
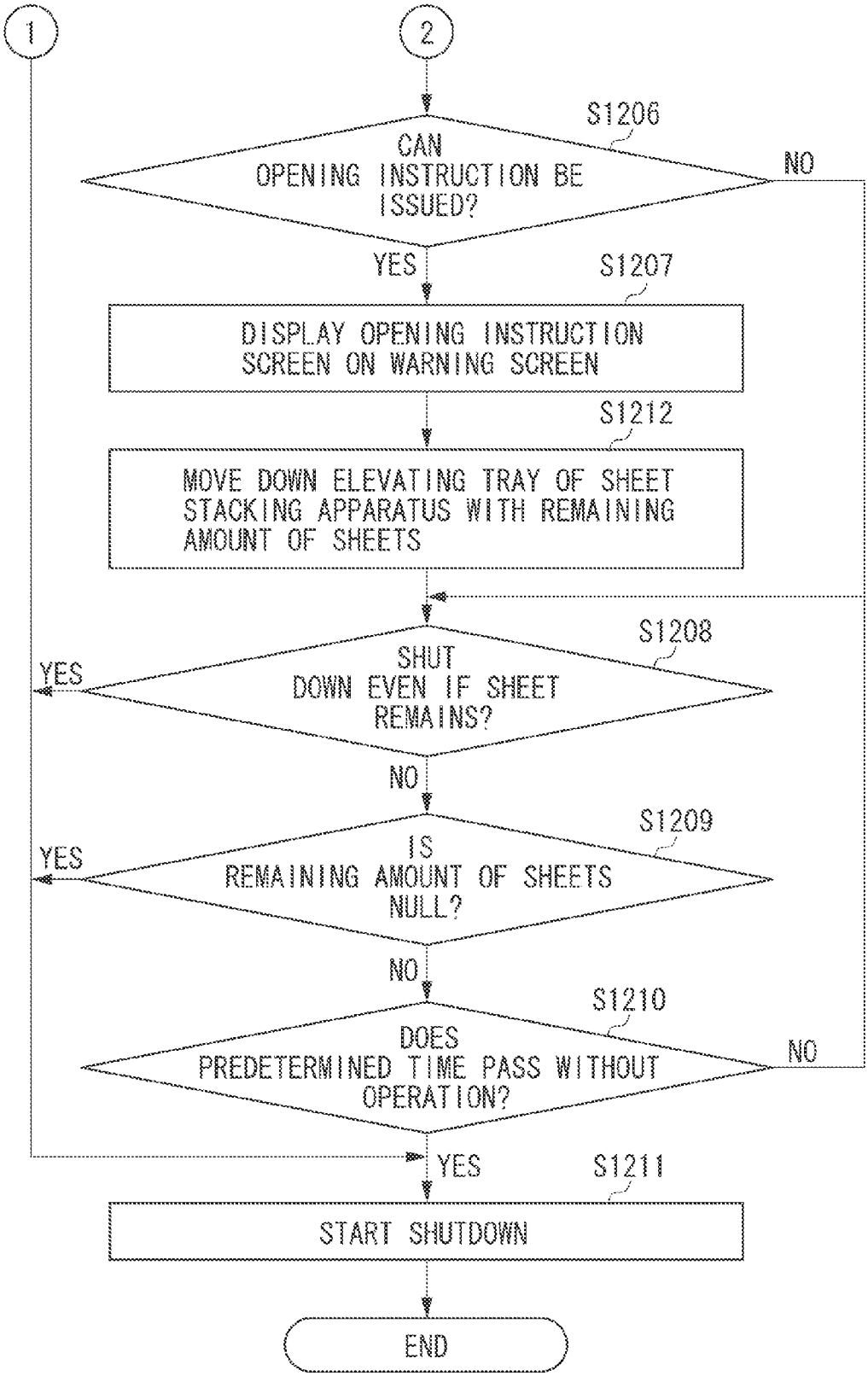

FIG. 13, which is composed of FIGS. 13A and 13B, illustrates a flowchart of a control method for a sheet post-processing apparatus according to a third exemplary embodiment. In this example, the discharging sheet stacking apparatus 222 is shut down. Steps are realized by loading a control program stored in the ROM 210 or the HDD 211 to the RAM 206 and executing the control program by the CPU 205. In the following description, the discharging sheet stacking apparatus 222 includes a plurality of stacking units, e.g., a top tray, a right stacker, and a left stacker each having a sensor that can detect whether there is the sheet P. Processing in steps S1200 to S1211 is similar to that in steps S1100 to S1111 in FIG. 7, and is, therefore, omitted from the description. The CPU 205 proceeds from step S1207 to step S1212. In step S1212, the CPU 205 controls an elevating mechanism to move down the elevating tray of the sheet stacking apparatus with the remaining amount of the sheets P. Then, the CPU 205 proceeds to step S1208. Other processing flows are similar to those according to the first exemplary embodiment.

Thus, when an instruction for opening the sheet stacking apparatus is issued, a time for moving down the elevating tray can be omitted. Therefore, a time for extracting the sheet P can be shortened.

The flowcharts in FIGS. 7 and 13 can be simultaneously applied to the discharging sheet stacking apparatus 300 and the feeding sheet stacking apparatus 700. The shutdown processing at that time is realized by performing processing in the flowcharts in FIGS. 7 and 13 on the discharging sheet stacking apparatus 300 and the feeding sheet stacking apparatus 700 by the CPU 205.

At this time, a UI screen (setting screen) illustrated in FIG. 14 can be displayed on the display unit of the operation unit 45 to prepare a setting for selecting and registering the sheet stacking apparatus by the user.

The CPU 205 allows the setting screen in FIG. 14 to be displayed on the display unit of the operation unit 45, and a setting value is stored in the HDD 211 in response to an instruction from the user. Thus, a candidate of the sheet stacking unit to be displayed for warning depending on user's preference can be registered on the HDD 211.

In such a case, in step S1103 in FIG. 7, the CPU 205 reads the setting value stored in the HDD 211. When there is the remaining amount of the sheets P of the apparatus based on the setting value, the CPU 205 proceeds to step S1104.

In the flowchart of FIG. 7, in step S1101, the CPU 205 determines whether the type of shutdown is a physical power supply switch (seesaw switch) in the image forming apparatus main body 1. In this case, a UI screen illustrated in FIG. 15 can be displayed on the display unit of the operation unit 45.

Thus, a setting may be prepared to select the type of shutdown by the user to issue a warning.

The CPU 205 displays the UI screen (setting screen) illustrated in FIG. 15 on the display unit of the operation unit 45, and the setting value is stored in the HDD 211 in response to an instruction from the user. In step S1101 in FIG. 7, the CPU 205 reads the setting value stored in the HDD 211. If the shutdown processing in step S1100 is the set type (YES in step S1101), the CPU 205 proceeds to step S1102.

With the setting for warning using the UI screen illustrated in FIG. 14 or 15 by the user, if the user who issues the shutdown instruction for turning off the power supply is not near the sheet stacking apparatus and wants to immediately turn off the power supply without the warning, the power supply can be quickly shut down.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable storage medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-019435 filed Feb. 1, 2012, which is hereby incorporated by reference herein in its entirety.

What is claimed is:

1. An image forming apparatus which performs image forming processing on sheets and outputs the sheets to a sheet stacking unit, the image forming apparatus comprising:

a reception unit configured to receive an instruction for shutting down the image forming apparatus;

an acquisition unit configured to acquire a remaining amount of sheets stacked in the sheet stacking unit; and a control unit configured to display, when the reception unit receives the instruction, a warning indicating a shift to a state in which sheets are not extractable from the sheet stacking unit, based on the remaining amount of sheets acquired by the acquisition unit.

2. The image forming apparatus according to claim 1, further comprising a determination unit configured to determine, when the instruction for shutting down the power is received by the reception unit, whether the sheets are extractable from the sheet stacking unit after the power is shut down, and wherein, when the determination unit determines that the sheets are not extractable from the sheet stacking unit after the power is shut down, the control unit displays a warning indicating a shift to a state in which the sheets are not extractable from the sheet stacking unit due to shutdown of the power.

3. The image forming apparatus according to claim 1, wherein the sheet stacking unit includes a door/tray control unit configured to control an operation for moving the sheet tray down and releasing a lock mechanism for a door usable to extract the sheets from the sheet tray based on an instruction for opening the door and to control an operation for setting the lock mechanism of the door and moving the sheet tray up based on an instruction for closing the door.

4. The image forming apparatus according to claim 3, wherein the door/tray control unit sets the lock mechanism to prevent reception of the instruction for opening the door when the power is shut down.

5. The image forming apparatus according to claim 1, further comprising a registration unit configured to register a sheet stacking unit for which the warning is displayed when the sheet remains at when the power is shutdown.

6. The image forming apparatus according to claim 1, further comprising a determination unit configured to determine, when the instruction for shutting down the power is received by the reception unit, whether the sheets are extractable from the sheet stacking unit after the power is shut down, and wherein, when the determination unit determines that the sheets are not extractable from the sheet stacking unit after the power is shut down, the control unit displays a button for receiving the instruction for forcibly shutting down, and a button for receiving an instruction for opening a door of the sheet stacking unit.

7. An image forming apparatus configured to perform image forming processing with a plurality of sheet stacking units connected thereto for stacking sheets on a sheet tray movable up and down, the image forming apparatus comprising:

an acquisition unit configured to acquire, from each of the plurality of sheet stacking units, a remaining amount of sheets stacked in each sheet stacking unit;

a reception unit configured to receive an instruction for shutting down power to at least one of the plurality of sheet stacking units; and a control unit configured to display, based on the remaining amounts of sheets acquired from respective sheet stacking units, a warning indicating a shift to a state in which sheets are not extractable from any of the plurality of sheet stacking units due to shutdown of the power when the reception unit receives the instruction for shutting down the power.

8. The image forming apparatus according to claim 7, further comprising a determination unit configured to determine, when the reception unit receives the instruction for shutting down the power, whether the sheets are not extractable after the power is shut down, wherein, when the determination unit determines that the sheets are not extractable after the power is shut down the control unit displays a warning indicating a shift to a state in which the sheets are not extractable from any of the plurality of sheet stacking units due to shutdown of the power.

9. The image forming apparatus according to claim 7, wherein the reception unit receives an instruction for shutting down the power from an external apparatus.

10. The image forming apparatus according to claim 7, wherein the reception unit receives an instruction for shutting down the power from a power shutdown timer.

11. A method for controlling an image forming apparatus configured to perform image forming processing with a plurality of sheet stacking units connected thereto for stacking sheets on a sheet tray movable up and down, the method comprising:

acquiring, from each of the plurality of sheet stacking units, a remaining amount of sheets stacked on the sheet tray in each sheet stacking unit;

receiving an instruction for shutting down power to at least one of the plurality of sheet stacking units; and displaying, based on the remaining amounts of sheets acquired from the respective sheet stacking units, a warning indicating a shift to a state in which the sheets are not extractable from any of the sheet stacking units due to shutdown of the power when the instruction for shutting down the power is received.

12. A computer-readable storage medium storing a program that causes a computer to execute the method according to claim 11.

* * * * *